US007230246B2

(12) United States Patent
Hawman

(10) Patent No.: US 7,230,246 B2
(45) Date of Patent: Jun. 12, 2007

(54) SYSTEM AND METHOD FOR PROVIDING SLANT-ANGLE COLLIMATION FOR NUCLEAR MEDICAL IMAGING

(75) Inventor: Eric G. Hawman, Schaumburg, IL (US)

(73) Assignee: Siemens Medical Solutions USA, Inc., Malvern, PA (US)

( * ) Notice: Subject to any disclaimer, the term of this patent is extended or adjusted under 35 U.S.C. 154(b) by 0 days.

(21) Appl. No.: 11/239,195

(22) Filed: Sep. 29, 2005

(65) Prior Publication Data

US 2007/0069136 A1 Mar. 29, 2007

(51) Int. Cl.
*G21K 1/02* (2006.01)
*G21K 5/10* (2006.01)

(52) U.S. Cl. ..... 250/363.1; 378/147

(58) Field of Classification Search ..... 250/363.1, 250/362; 378/147, 149, 150

See application file for complete search history.

(56) References Cited

U.S. PATENT DOCUMENTS 4,250,392 A * 2/1981 Leask et al. ..... 250/505.1
4,419,585 A * 12/1983 Strauss et al. ..... 250/505.1
4,419,763 A * 12/1983 Hawman ..... 378/149
4,597,096 A * 6/1986 Larsson ..... 378/149
6,353,227 B1 * 3/2002 Boxen ..... 250/363.1
2003/0111609 A1 * 6/2003 Zeng ..... 250/363.1

* cited by examiner

*Primary Examiner*—David Porta
*Assistant Examiner*—Mark R. Gaworecki

(57) ABSTRACT

Method and arrangement for implementing a system (10) for providing multi-angular SPECT radiation sampling utilizing slant-angle collimation. The system (10) includes a collimator (13) positioned between a radiating mass (19) within a patient (60) and a radiation detector (21). The collimator (13) is spaced apart from a translational path (25) of the radiating mass (19) at a predefined distance (24). A plurality of apertures (27) extend through the collimator (13) and each forms a passageway (28) for radiation rays (20) emanating from the radiating mass (19) in a direction substantially aligned with a longitudinal axis (29) of the respective passageway (29) and in this manner enables the aligned radiation rays (20) to strike the radiation detector (21). The plurality of passageways (28) include a first group (30) of passageways adjacently aligned in a first row (32) and arranged so that the longitudinal axes (29) of the first group (30) of passageways (32) are substantially contained in a first plane (34) oriented substantially perpendicularly to a central plane (16) of the collimator (13). Each of the parallel longitudinal axes (29) of the first row (32) of passageways are obliquely oriented with respect to the central plane (16) of the collimator (13) with an included angle (36) therebetween. Each of the included angles, when measured clockwise from the central plane (16) or face of the collimator (13) to a respective longitudinal axis, is an acute angle.

19 Claims, 5 Drawing Sheets

SYSTEM AND METHOD FOR PROVIDING SLANT-ANGLE COLLIMATION FOR NUCLEAR MEDICAL IMAGING

BACKGROUND OF THE INVENTION

1. Field of the Invention

The present invention relates to systems and methods used in radiation imaging; and more particularly, to collimators utilized in cooperation with radiation detectors that permit only desired radiation to strike the detector thereby producing a more accurate image-of-interest, typically of an internal portion of a patient when medical and diagnostic applications are considered.

2. Description of the Background Art

In conventional radiation imaging arrangements, collimators are used in a wide variety of equipment in which it is desired to permit only beams of radiation emanating along a particular path to pass a selected point or plane. Collimators are frequently used in radiation imagers to ensure that only radiation beams passing along a direct path from the known radiation source strike the detector thereby minimizing detection of beams of scattered or secondary radiation.

Particularly in radiation imagers used for medical diagnostic analysis or for non-destructive evaluation procedures, it is important that only radiation emanating from a known source and passing along a direct path from that source be detected and processed by the imaging equipment. If the detector is struck by undesired radiation such as that passing along non-direct paths to the detector, performance of the imaging system can be degraded.

Collimators are positioned to substantially absorb the undesired radiation before it reaches the detector. The collimator includes (or is manufactured from) a relatively high atomic number material and the collimator is positioned so that undesired radiation strikes the body of the collimator and is absorbed before being able to strike the detector. In a typical detector system the collimator includes barriers associated with the detector and located in the direction of the radiation source. An example exists in radiation imaging systems used for medical diagnosis which use a small point source of radiation to expose the patient under examination. The radiation passes through the patient and strikes a radiation detector that is oppositely positioned.

Another diagnostic technology that incorporates collimators is the gamma camera typically utilized in Single Photon Emission Computed Tomography (SPECT) scanning, which is a nuclear medicine procedure in which gamma camera(s) have traditionally rotated around the patient taking pictures from many angles. From these images, a computer is employed to form a tomographic (cross-sectional) image of the internal area-of-interest within the patient using a calculation process that is similar to that used in X-ray Computed Tomography (CT) and in Positron Emission computed Tomography (PET).

In the instance of SPECT scanning, a subject (patient) is infused with a radioactive substance that emits gamma rays. Conventionally, a gamma camera includes a transducer to receive the gamma rays and record an image therefrom. In order for the image to be a true representation of the subject being investigated, a collimator having collimating apertures is positioned between the transducer and the subject to screen out all of the gamma rays except those directed along a straight line through the collimating apertures between a particular part of the subject and a corresponding particular part of the transducer. Traditionally, the collimator is made of a radiation opaque material such as lead, and collimating apertures have been formed therein by various means such as drilling, casting, or lamination of corrugated strips of lead foil.

In conventional SPECT system designs, the gamma cameras have been supported on gantries that rotate the camera heads through a specific angular range around the patient, usually covering one hundred eighty or three hundred and sixty degrees. One drawback associated with this requirement however, is that such gantry systems are relatively expensive subsystems of the diagnostic tool because they must be capable of providing rapid rotation is of the large and heavy camera heads through very precise orbits about the patient. As a result, the object of the present invention is to accommodate the use of lower cost, simplified gantries, without sacrificing image quality, or driving the cost of related subsystems higher.

SUMMARY OF THE INVENTION

In an effort to remedy the deficiencies outlined above with respect to SPECT scanning, the present invention, at least in one aspect, is directed toward a method and arrangement for affecting collimation that allows the required angular views for SPECT scanning to be obtained using only one-dimensional relative linear motion between the camera and the patient. This type of operation is important because, among other reasons, the systems utilized in the ever increasingly popular whole body scanning technologies predominantly already utilize such relative linear motion between the scanning device and the patient, in addition to the camera's rotation. In fact, such whole body studies are a mainstay in clinical nuclear medicine and therefore their efficiency is of paramount importance.

The present invention relies on a collimator in which the angle of view varies across the collimator. With this type of collimator, SPECT systems based on substantially complete angular sampling can be devised for single and multiple headed camera systems that require as few as a single pass of the camera along the patient, without relative rotation between the patient and camera, while also minimizing the length of the translational pass required of the camera. Important advantages will be seen in cost savings for the gantry, simplification of setup and operation, and for some configurations, significantly smaller space requirements for the incorporating systems. To this end, one embodiment of the invention takes the form of a system utilizing slant-angle collimation for SPECT radiation sampling. The system comprises (includes, but is not necessarily limited to) a collimator positioned between a radiating mass and a radiation detector. The collimator is spaced apart from a translational path of the radiating mass at a predetermined distance that defines a patient accommodation space. Apertures extend through the collimator and form passageways for gamma (radiation) rays emanating from the radiating mass to strike the radiation detector.

In summary, the provision and utilization of collimators configured according to the teachings above facilitate enhanced radiological imaging quality, while at the same time simplifying and reducing the cost of the support structures required to carry the necessary instruments and which affect relative, longitudinal motion between those instruments and the patient. Among other benefits, the method and arrangement of the present invention permits the utilization of exclusively longitudinal relative motion between the patient and imaging instruments compared to the orbital motion about the patient which has been previously required when conducting such procedures as full body scanning.

BRIEF DESCRIPTION OF THE DRAWINGS

The invention as described herein can be best appreciated and understood when taken in conjunction with the accompanying drawings, in which.

DETAILED DESCRIPTION OF THE PREFERRED EMBODIMENTS

Figure 1:
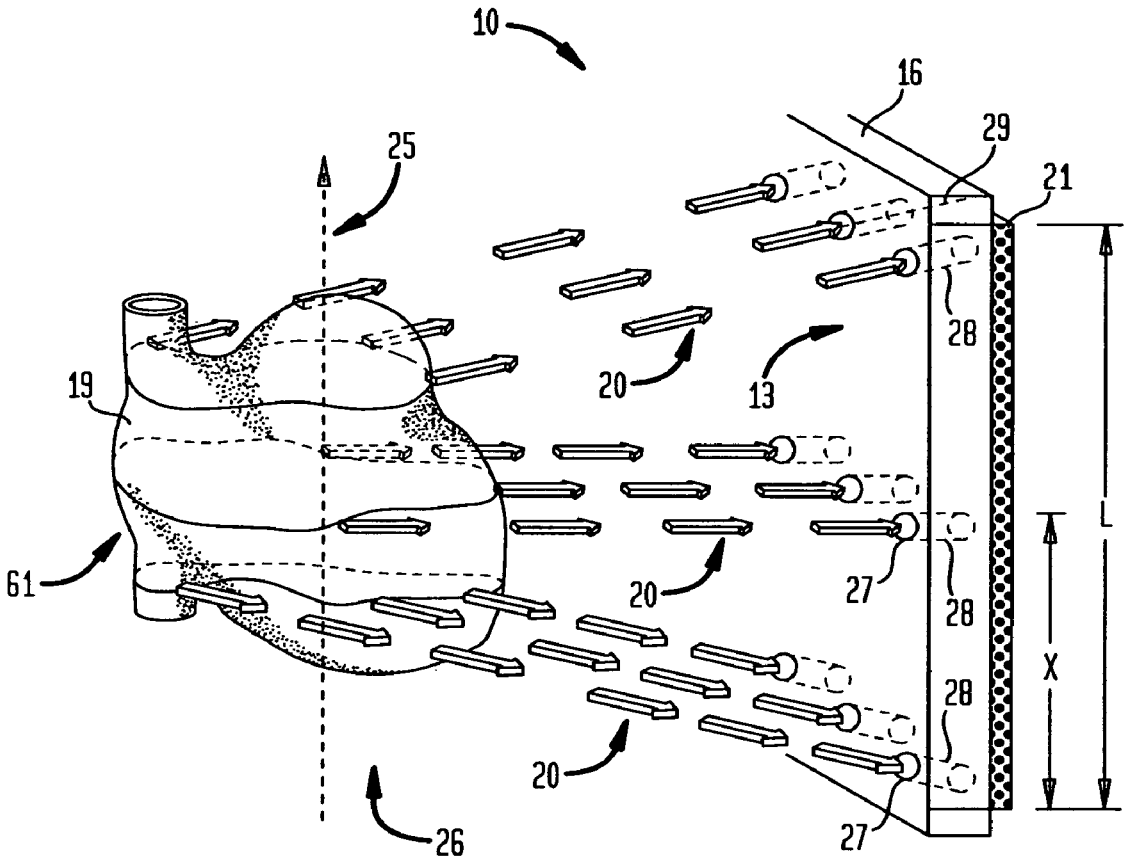
FIG. 1 is a perspective view of a radiating mass (heart), a collimator and a radiation (gamma ray) detector showing three rows of radiation-receiving passageways extending through the collimator, and in which the passageways of each of the rows have different slant-angles.

When considering full angular gamma camera sampling utilizing SPECT parallel projection views, or their equivalents, the image samples should be obtained over one hundred and eighty or three hundred and sixty degrees. According to the present invention, a system (10) is provided that includes a collimator (13) adapted with apertures (27) that serve as openings for slant-angle passageways (28) which accommodate views of a radiating area or object-of-interest (61), such as the heart of a patient (19), from a specific slant-angle.

Referring to FIG. 1, the specific angle at which the slotted passageway (28) is canted within the collimator (13) is dependent on the relative position (x) of the passageway (28) in the collimator (13). In the instance of FIG. 1, the radiation source is the radiating mass (19) shown as the radioactively infused heart (19) of a patient. For each row of passageways (28) through the collimator (13), the associated collimated (gamma) rays travel along lines that establish planes perpendicular to a representative or central plane (16) of the collimator (13). From the top to the bottom of the collimator (assuming a vertical orientation of the collimator (13) as shown in FIG. 1), the slant-to-the-side-angle of the passageways (28) in each row can vary, with a preferential range of variability spanning between plus/minus forty-five degrees.

As previously described, FIG. 1 illustrates one example of a system (10) for providing multi-angular SPECT sampling of gamma rays (radiation) emanating from at least a part of a patient using a collimator with side-slant-angles which vary from row-to-row up the face of the collimator (13). As shown, the collimator (13) is positioned between the radiation source (19) and a radiation detector (21). The collimator (13) is spaced apart from the path (25) of the radiation source (19) at a predetermined distance (24) that generally defines a patient accommodation space (26). The plurality of apertures extend through the collimator (13), and each forms a passageway (28) for radiation rays (20) emanating from the radiation source (19) and allows those rays (20) to strike the radiation detector (21). The passageways (28) are composed of a series of adjacent and parallel elongate apertures.

Because the collimator (13) has a thickness, these passageways (28) are channel-like and each has a longitudinal axis (29) that is substantially aligned with the collimated radiation rays (20) that are permitted to pass through that particular channel (29). In order to effect a desired alignment between each channel (28) and respective rays (20) that must pass therethrough, the longitudinal axis (29) of the channels (28) is obliquely oriented with respect to a central plane (16) of the collimator (13).

Collectively, the several figures depict several configurations and methods for implementing a system (10) for providing multi-angular SPECT radiation sampling utilizing slant-angle collimation according to the present invention. The system (10) comprises a collimator (13) positioned between a radiating mass (19) within a patient (60) and a radiation detector (21). The collimator (13) is spaced apart from a translational path (25) of the radiating mass (19) at a predefined distance (24) that defines a patient accommodation space (26).

A plurality of apertures (27) extend through the collimator (13), and each forms a passageway (28) for radiation rays (20) emanating from the radiating mass (19) in a direction substantially aligned with a longitudinal axis (29) of the respective passageway (29) and in this manner enables the aligned radiation rays (20) to strike the radiation detector (21). The plurality of passageways (28) include a first group (30) of passageways adjacently aligned in a first row (32) and arranged so that the longitudinal axes (29) of the first group (30) of passageways (32) are substantially contained in a first plane (34) oriented substantially perpendicularly to a central plane (16) of the collimator (13).

Each of the parallel longitudinal axes (29) of the first row (32) of passageways is obliquely oriented with respect to the central plane (16) of the collimator (13) with an included angle (36) therebetween. On this row (32), each of the included angles, when measured clockwise from the central plane (16) or face of the collimator (13) to a respective longitudinal axis, is an acute angle.

Figure 2A:
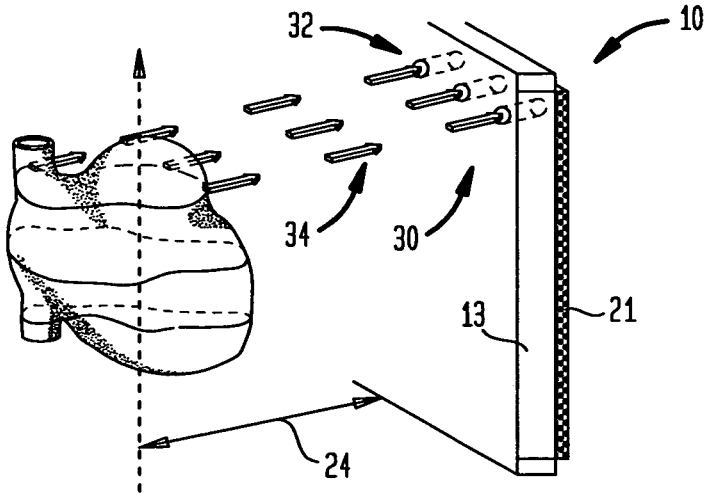
FIGS. 2*a-c* is a series of perspective views in which each shows a single row of collimator passageways, the gamma rays which are received therethrough, and the respective slice-views or samplings of the heart that are obtained from the particular slant-angle shown.
Figure 2B:
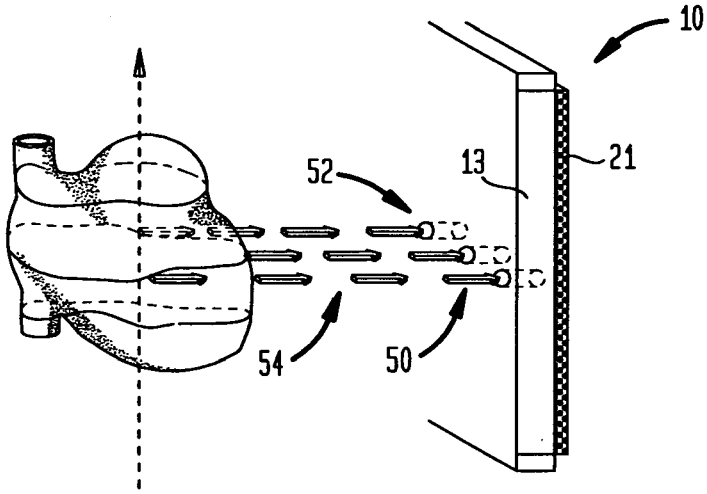
Figure 2C:
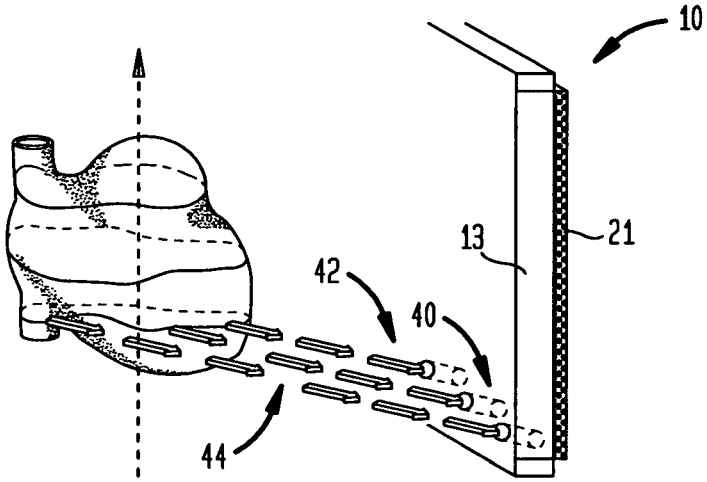

As may be best appreciated in FIGS. 1-2*c*, the system (10) preferably further includes a second group (40) of passageways (28) adjacently aligned in a second row (42) and arranged so that the longitudinal axes (29) of the second group (40) of passageways (28) are substantially contained in a second plane (44) oriented substantially perpendicularly to a central plane (16) of the collimator (13).

A second group (40) of passageways (28) are adjacently aligned in a second row (42) and arranged so that the longitudinal axes (29) of that group are substantially contained in a second plane (44) which is also oriented substantially perpendicularly to the central plane (16) of the collimator (13). The second row (42) of passageways is spaced apart from the first row of passageways at a predefined distance, L, which essentially defines the length or height of the collimator (13). Each of the parallel longitudinal axes (29) of the second row (42) of passageways (28) is obliquely oriented with respect to the central plane (16) of the collimator (13) with an included angle, each of which when measured clockwise from the central plane (16) of the collimator (13) to a respective longitudinal axis (29), is obtuse.

As illustrated in FIGS. 1-4, a third row (52, 52*b*) of passageways (28) is also provided and which is spaced apart from the first row (32) of passageways (28) at a predefined distance (X). Each of the parallel longitudinal axes (29) of the third row (42) of passageways (28) is substantially perpendicularly oriented with respect to the central plane (16) of the collimator (13).

Figure 3:
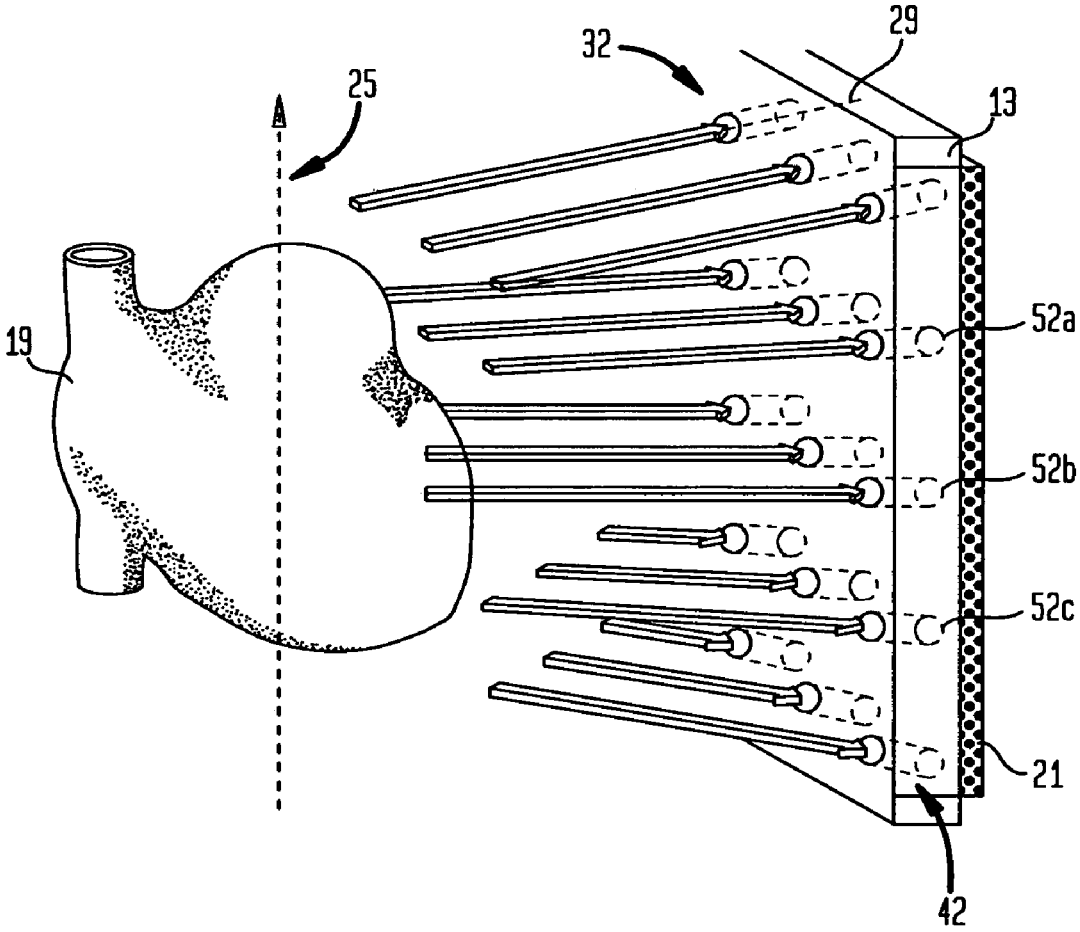
FIG. 3 is a perspective view showing five rows of differently slant-angled passageways, and thereby demonstrating by comparison to FIG. 1 how more fully developed images of the radiating mass (heart) is developed by adding additional rows to the array of collimator passageways.

As is illustrated in FIG. 3, however, there may be multiple additional rows (52*a*, 52*b*, 52*c*) of passageways (28), each of which is located at a different spacing distance from first row (32) of passageways (28). In this case, the side slant-angle of the passageways (28) of the row (52*a*, 52*b*, or 52*c*) is based on the predefined spacing distance (X) of the particular row (52*a*, 52*b*, or 52*c*) from the first row (32) of passageways (28). As before, the predefined distance between the extreme first row (32) of passageways (28) and the second row (42) of passageways (28) is defined by the effective collimator length (L). A difference between the measurement of the obtuse included angle (46) and the measurement of the acute included angle (36) define a sweep angle or range of angles of the passageways (28) of the different rows (32-52).

In the embodiment of FIG. 3, regarding each interstitial row (52*a*, 52*b*, or 52*c*), the parallel longitudinal axes of that row (52*a*, 52*b*, or 52*c*) of passageways (28) is obliquely oriented with respect to the central plane (16) of the collimator (13) with an included angle therebetween. Each of the included angles, when measured clockwise from the central plane of the collimator to a respective longitudinal axis, is defined as a proportion of the sweep angle. Preferably, the proportion is defined by the distance, X, of the particular row (52*a*, 52*b*, or 52*c*) from the first row (32) of passageways (28) divided by the distance, L, of the first row (32) of passageways from the second row (42) of passageways (28).

It should be appreciated that for purposes of clarity each of the several apertures (27) in any given row in the collimator (13) have been shown with a certain amount of space therebetween. In actuality, however, each row of passageways contains a sufficient number of passageways arranged close together to effectively form an elongate slot through the collimator along that row.

Figure 4A:
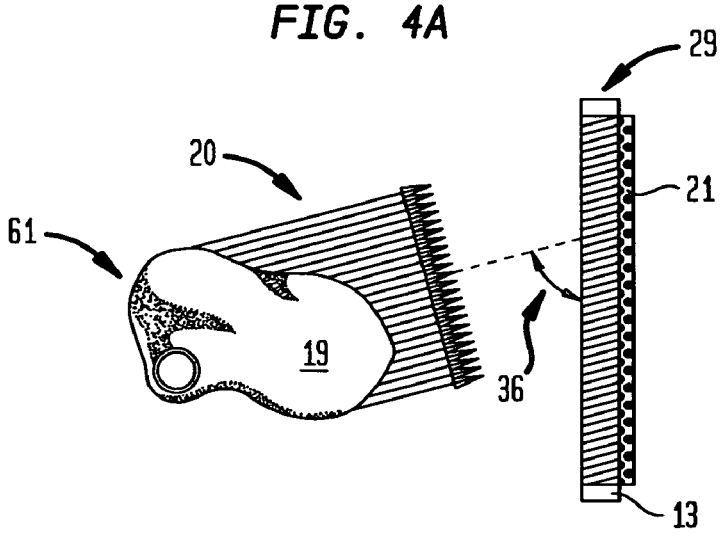
FIGS. 4*a-c* is a series of plan or slice views corresponding essentially to FIGS. 2*a-c* and which demonstrate the slant-angle characteristic of both the filtered gamma rays and the aligned passageways which together enable the taking of the essentially planar slant views of the heart when many closely adjacent passageways are included in the row.
Figure 4B:
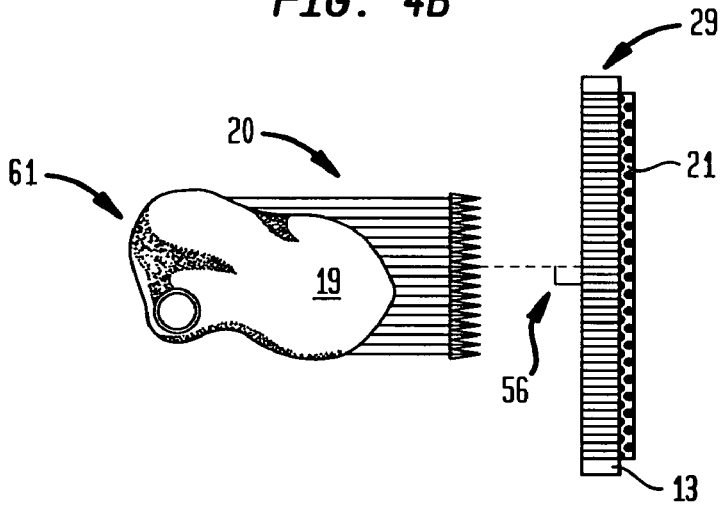
Figure 4C:
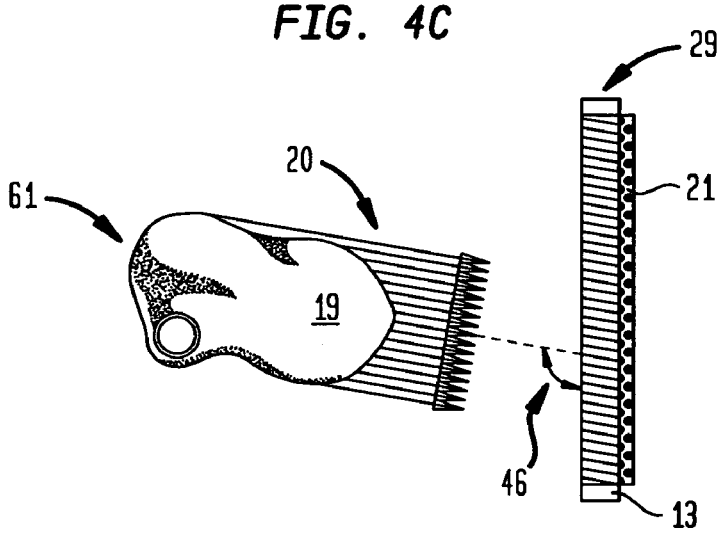

As may be best appreciated in FIGS. 4*a*-4*c*, the obtuse 46) included angles (FIG. 4*c*) associated with the second row (42) of passageways (28) are approximately one hundred and thirty-five degrees as measured clockwise from the central plane (16) of the collimator (13) to a respective passageway's (28) longitudinal axis (29).

The acute (36) included angles (FIG. 4*a*) associated with the first row (32) of passageways (28) are approximately forty-five degrees as measured clockwise from the central plane (16) of the collimator (13) to a respective passageway's (28) longitudinal axis (29).

As may be best appreciated in FIGS. 4*a*-*c*, the predefined distance at which the collimator (13) is positioned from the translational path (25) of the radiating mass (19) is selected so that approximately one-half of a translating radiating mass (19) is multi-angularly, SPECT radiation sampled through the collimator (13) in a single translational pass of the radiating mass (19) relative to the radiation detector (21).

Figure 5:
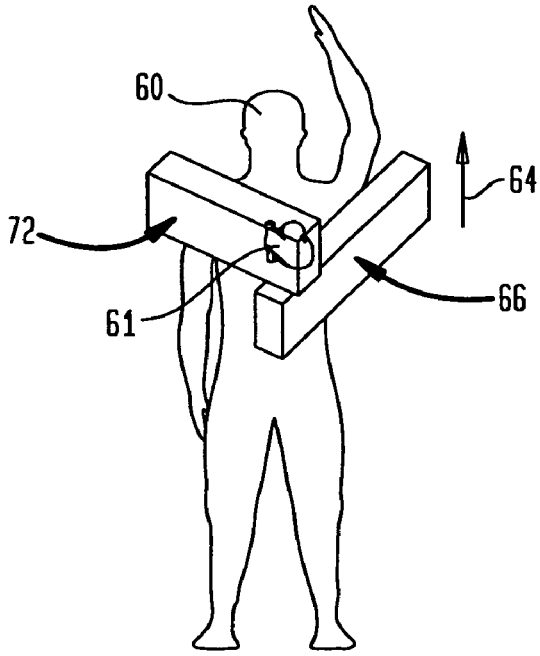
FIG. 5 is a perspective view of a pair of gamma cameras configured at right angles to one another and mounted for linear scan motion relative to a standing patient.

As may be gleaned from FIG. 5, in a preferred embodiment the collimator (13) is mounted on an instrument support assembly and the instrument support assembly is associated with a motive means for affecting longitudinal relative motion between the instrument support assembly and a patient (60) for taking the multi-angular SPECT radiation sampling of the radiating mass (19) in the patient (60) utilizing the variously slant-angled passageways (28) and without requiring relative rotation between the patient (60) and the instrument support assembly.

In a preferred embodiment, the collimator (13) and the detector (21) are each mounted on an instrument support assembly in fixed orientation with one another. The instrument support assembly is associated with a motive means for affecting longitudinal relative motion between the instrument support assembly and a patient (60) for obtaining the necessary slant-angular sampling of an area-of-interest (61) in the patient without requiring relative rotation between the patient and instrument support assembly. From the image data obtain for each longitudinal scan position, projection sinograms can be formed for each slice of the object. From the sinograms transverse tomographic slices of the object can be reconstructed.

Figure 6:
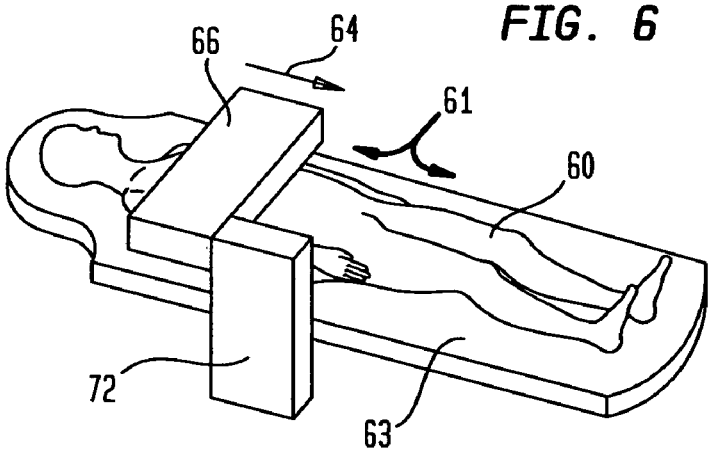
FIG. 6 is a schematic perspective view of a pair of gamma cameras configured at right angles to one another and mounted for linear scan motion relative to a reclined patient.
Figure 7:
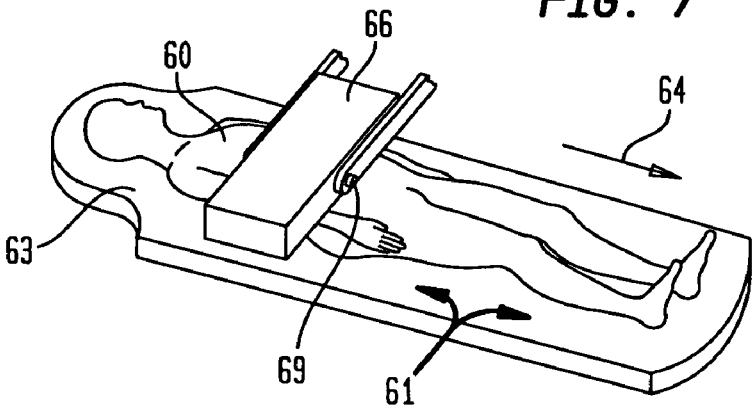
FIG. 7 is a schematic perspective view of a single gamma camera positioned above a patient, aimed at the patient's back and supported for linear scan motion along the length of the patient.

As illustrated in FIGS. 5-7, a preferred utilization of such a collimator (13) is depicted as a component in a gamma camera (66, 72). The camera arrangement (66, 72) then moves along the length of the patient (60). Alternatively, the patient (60) may be moved with respect to one or more of the stationary cameras (66, 72). From this, projection views of transverse slices of the patient (60) are sensed for each row of passageways (28) at slant angles that sweep across the angular range of the collimator (i.e., plus/minus forty-five degrees). As a result, multi-angular sampling is facilitated without camera rotation about the patient. These varied angular views, with appropriate scaling, can be used for the reconstruction of three-dimensional SPECT images of the scanned patient region (organ) (61) in question.

For full angular sampling, SPECT can be implemented using two heads (66, 72) as illustrated in FIGS. 5 and 6. Alternatively, a single head (66) and two or more linear scans over the area-of-interest (61) in the patient (organ) (60) can be made as depicted in FIG. 7, and where for each scan there is a specified fixed tilt angle of the camera head (66).

The illustrated implementation is as a cardiac SPECT camera. Because the cameras (66, 72) move up and down lengthwise along the patient (60), or alternatively, the patient (60) rises up and down relative to the cameras (66, 72), a relatively small equipment footprint is required and thereby constitutes a space-saving diagnostic instrument. In the examples, two rectangular cameras (66, 72), each have a plus/minus forty-five degree varying slant collimator, are fixedly mounted, orthogonally and staggered with respect to one another.

Using the example of FIG. 5, in order to obtain comprehensive views of the heart or other area-of-interest (61) in the patient (60), that part (61) of the patient (60) is initially located so that an upper portion of the heart (61) is at the lower edge of the field-of-view for the lower camera (66). The patient (60) can then be moved upward until the bottom of the heart (61) is positioned above the upper edge of the field-of-view for the upper camera (72). With this linear scan, angular, projection views for each cross-section of the heart are obtained (61) covering approximately one hundred and eighty degrees (or one-half) from each camera and which allows substantially full, high-quality SPECT reconstruction.

Referring to FIG. 5 in which the patient (60) is moved relative to the cameras (66, 72) in the direction indicated by arrow 64, the institution of such motion requires, for example, a vertically driven platform. In an arrangement of this nature, it has been found to be useful for keeping the patient immobile and stable to affix two thin, rigid vertical walls to the platform. The chest of the patient is then snugly pressed and secured against the walls with, for example, tape or straps, if necessary. Preferably, these walls are constructed of low attenuation material for gamma rays. As a further enhancement, it is contemplated that the walls can be adapted with a window over the heart region thereby more completely avoiding interference caused by the walls' presence. In this example, faces of the cameras (66, 72) glide over outer surfaces of the walls as the platform is raised. Thus, during the entire scan, the heart (61) will be very close to the detectors (21) of the gamma cameras (66, 72), which is beneficial for achieving good spatial resolution. In a preferred embodiment, a system (10) of this configuration can be sized to fit within a floor space of three feet by three feet.

FIG. 6 shows a non-rotating, dual-head, whole body SPECT system having two camera heads that are again orthogonally fix-mounted as depicted in FIG. 5. The cameras (66, 72) and/or patient bed (63) are capable of moving in a horizontal straight line for whole body scanning. As shown, the patient (60) is lying on a pallet with one camera (66) facing or aimed at the front of the patient (60) and the other camera (72) facing the patient's side. Linear scan motion from the patient's head to feet provides the necessary angular views for complete whole body SPECT reconstruction. In this configuration, the perpendicular cross-sectional projections produce orthogonal views (e.g. anterior and lateral). Because conjugate views, which differ by one hundred and eighty degrees, generally have significant differences due to attenuation, it can be desirable to make a second scan pass of the patient.

The present invention also contemplates utilization of a single head camera (66) that can be tilted about pivot point 69 and has linear whole body scan capability to perform transaxial SPECT. This is depicted in FIG. 7 where a two-pass linear scan is used. The camera head (66) has a plus/minus forty-five degree varying slant angle collimator. During the first linear scan pass, the camera (66) has a fixed tilt angle, shown as zero degrees, downward.

In this configuration, the collimator (13) and radiation detector (21) are incorporated components in a first gamma camera (66) that is aimed at the patient accommodation space (26). As described before, the first camera (66) is mounted on an instrument support assembly configured for longitudinal relative motion with respect to the patient accommodation space (26) for developing a first one pass, cross-angled radiation sampling of the area-of-interest (61) in the patient (60) without requiring relative rotation between the first camera and the patient accommodation space (26). The first gamma camera (66) is adjustably mounted for reconfiguration with respect to the patient accommodation space (27) thereby enabling the development of a second, different perspective, one pass, angular sampling of the area-of-interest (61) in the patient (60).

For the purpose of automatic data registration, it is advantageous to use fixed-point source markers attached to the patient, the patient pallet, or the walls of the cardiac configuration. For varying slant angle SPECT, the use of markers and their registration fulfills the same function as would center-of-rotation correction in conventional rotating camera SPECT. Namely, fixed points of the object must be back-projected at the proper angle and linear offset so as to be reconstructed as points.

It is known that slant collimation introduces a potential for resolution loss due to the thickness of the scintillation crystal. This effect is referred to as the parallax component of resolution, and can be regarded as a degradation of intrinsic resolution. This, however, is commonly taken into account in the design of the collimator so that system resolution specifications are achieved, perhaps with some tradeoff of sensitivity. In many cases, the resolution may be improved because the patient is more easily positioned closer to the detector for linear scanning than for rotational scanning.

While the invention has been described in detail above, the invention is not intended to be limited to the specific embodiments as described. It is evident that those skilled in the art may now make numerous uses and modifications of and departures from the specific embodiments described herein without departing from the inventive concepts.

What is claimed is:

1. A system for providing multi-angular SPECT radiation sampling utilizing slant-angle collimation, said system comprising:

a collimator positioned between a radiating mass within a patient and a radiation detector, said collimator being spaced apart from a translational path of the radiating mass at a predefined distance that defines a patient accommodation space;

a plurality of apertures extending through said collimator, each of said apertures forming a passageway for radiation rays emanating from said radiating mass in a direction substantially aligned with a longitudinal axis of the respective passageway and thereby enabling the aligned radiation rays to strike said radiation detector;

said plurality of passageways being arranged in a plurality of rows across said collimator and arranged so that said longitudinal axes of a first row of passageways are substantially parallel to each other and form a first angle with respect to a central plane of said collimator; and a second row of passageways being arranged so that said longitudinal axes of said second row of passageways are substantially parallel to each other and form a second angle with respect to said central plane of said collimator, where said second angle is different than said first angle.

2. The system as recited in claim 1, wherein said plurality of passageways further comprises:

a third row of passageways being arranged so that said longitudinal axes of said third row of passageways are substantially parallel to each other and form a third angle with respect to said central plane of said collimator, where said third angle is different than said first and second angles.

3. The system as recited in claim 2, wherein each row of passageways contains a sufficient number of passageways arranged sufficiently close together to effectively form an elongate slot through said collimator.

4. The system as recited in claim 2, wherein said second angle is approximately one hundred and thirty-five degrees as measured clockwise from said central plane of said collimator to a respective third row passageway's longitudinal axis.

5. The system as recited in claim 2, wherein said first angle is approximately forty-five degrees as measured clockwise from said central plane of said collimator to a respective first row passageway's longitudinal axis.

6. The system as recited in claim 5, wherein said third angle is approximately ninety degrees as measured clockwise from said central plane of said collimator to a respective passageway's longitudinal axis.

7. The system as recited in claim 6, wherein said predefined distance at which said collimator is positioned from the translational path of said radiating mass is selected so that approximately one-half of a translating radiating mass is multi-angularly, SPECT radiation sampled through said collimator in a single translational pass of the radiating mass relative to said radiation detector.

8. The system as recited in claim 2, further comprising:

said collimator being mounted on an instrument support assembly and said instrument support assembly being associated with a motive means for effecting longitudinal relative motion between said instrument support assembly and a patient for taking the multi-angular SPECT radiation sampling of the radiating mass in the patient utilizing the variously slant angled passageways and without requiring relative rotation between the patient and instrument support assembly.

9. The system as recited in claim 8, wherein said predefined distance at which said collimator is positioned from the translational path of said radiating mass is selected so that approximately one-half of the translating radiating mass is multi-angularly, SPECT radiation sampled through said collimator in a single translational pass of said radiating mass relative to said radiation detector.

10. The system as recited in claim 2, further comprising:

said collimator being mounted on an instrument support assembly and said instrument support assembly being associated with a motive means for effecting exclusively longitudinal relative motion between said instrument support assembly and a patient for taking the multi-angular SPECT radiation sampling of the radiating mass in the patient utilizing the variously slant angled passageways and without requiring relative rotation between the patient and instrument support assembly.

11. The system as recited in claim 10, wherein said predefined distance at which said collimator is positioned from the translational path of said radiating mass is selected so that approximately one-half of the translating radiating mass is multi-angularly, SPECT radiation sampled through said collimator in a single translational pass of said radiating mass relative to said radiation detector.

12. The system as recited in claim 2, wherein said collimator and radiation detector are incorporated components in a first gamma camera that is aimed at the patient accommodation space, said first camera being mounted on an instrument support assembly configured for longitudinal relative motion with respect to said patient accommodation space for developing a first one pass, multi-angular SPECT radiation sampling of the radiating mass in the patient utilizing the variously slant angled passageways and without requiring relative rotation between said first camera and said patient accommodation space.

13. The system as recited in claim 12, wherein said predefined distance at which said collimator is positioned from the translational path of said radiating mass is selected so that approximately one-half of the translating radiating mass is multi-angularly, SPECT radiation sampled through said collimator in a single translational pass of said radiating mass relative to said radiation detector.

14. The system as recited in claim 12, wherein said first gamma camera is adjustably mounted for reconfiguration with respect to said patient accommodation space thereby enabling the development of a second, different perspective, one pass, multi-angular SPECT radiation sampling of the radiating mass in the patient.

15. The system as recited in claim 14, wherein the aim of said first gamma camera is offset approximately ninety degrees between said first and second perspective, one pass, multi-angular SPECT radiation sampling of the radiating mass in the patient.

16. The system as recited in claim 12, further comprising:

a second gamma camera comprising a collimator and radiation detector, said second gamma camera being aimed at the patient accommodation space from a different perspective than said first gamma camera and thereby enabling the simultaneous development of two different perspective, one pass, multi-angular SPECT radiation samplings of the radiating mass in the patient.

17. The system as recited in claim 16, wherein said predefined distance at which said collimator is positioned from the translational path of said radiating mass is selected so that together with the configuration of the acute included angle at approximately forty-five degrees and the obtuse included angle at approximately one hundred and thirty-five degrees, approximately one-half of the translating radiating mass is multi-angularly, SPECT radiation sampled through said collimator in a single translational pass of said radiating mass relative to said radiation detector.

18. A system for providing multi-angular SPECT radiation sampling utilizing slant-angle collimation, said system comprising:

a collimator positioned between a radiating mass within a patient and a radiation detector;

a plurality of apertures extending through said collimator, each of said apertures forming a passageway for radiation rays emanating from said radiating mass in a direction substantially aligned with a longitudinal axis of the respective passageway and thereby enabling the aligned radiation rays to strike said radiation detector;

said plurality of apertures being arranged in a plurality of rows, longitudinal axes of apertures of each row being substantially parallel to each other, longitudinal axes of a first row adjacent to one edge of said collimator forming an angle of approximately ninety degrees with longitudinal axes of a row adjacently to an opposite edge of said collimator.

19. A system for providing multi-angular SPECT radiation sampling utilizing slant-angle collimation, said system comprising:

a collimator positioned between a radiating mass within a patient and a radiation detector;

a plurality of apertures extending through said collimator, each of said apertures forming a passageway for radiation rays emanating from said radiating mass in a direction substantially aligned with a longitudinal axis of the respective passageway and thereby enabling the aligned radiation rays to strike said radiation detector;

said plurality of apertures being arranged in a plurality of rows across said collimator, longitudinal axes of apertures of each row being substantially parallel to each other and pointing in a different direction than longitudinal axes of other rows.

* * * * *